United States Patent [19]

Yoshii

[11] Patent Number: 4,652,702

[45] Date of Patent: Mar. 24, 1987

[54] EAR MICROPHONE UTILIZING VOCAL BONE VIBRATION AND METHOD OF MANUFACTURE THEREOF

[76] Inventor: Ken Yoshii, C2 - 201 Sun Mansion, Nagoya, Japan

[21] Appl. No.: 697,272

[22] Filed: Feb. 1, 1985

[51] Int. Cl.[4] ..... H04R 1/28; H04R 17/02; H04R 31/00

[52] U.S. Cl. ..... 381/151; 29/594; 381/68.3

[58] Field of Search ..... 179/121 C, 121 D, 107 E, 179/107 BC, 146 R, 179, 180, 116 A; 29/592 R, 594

[56] References Cited

U.S. PATENT DOCUMENTS

| | | | |
|---|---|---|---|
| 4,150,262 | 4/1979 | Ono | 179/107 BC |
| 4,323,999 | 4/1982 | Yoshizawa et al. | 179/107 E |
| 4,334,315 | 1/1982 | Ono et al. | 179/107 BC |
| 4,396,807 | 8/1983 | Brewer | 179/146 R |
| 4,546,950 | 10/1985 | Cech | 179/146 R |
| 4,588,867 | 5/1986 | Konomi | 179/107 BC |

FOREIGN PATENT DOCUMENTS

| | | | |
|---|---|---|---|
| 59-33388 | 3/1984 | Japan . | |
| 2160388A | 12/1985 | United Kingdom | 179/110 A |

*Primary Examiner*—Gene Z. Rubinson
*Assistant Examiner*—Danita R. Byrd
*Attorney, Agent, or Firm*—Kinney & Lange

[57] ABSTRACT

This invention, directed to a displacement type bone vibration ear microphone possessing an electroacoustic transducer element planted in one of the end faces of a support member and a damper member formed so as to enclose therewith the electroacoustic transducer element, is characterized by disposing a flexible reinforcing member around or near the electroacoustic transducer element, allowing a free end of the electroacoustic transducer element and a outer end of the reinforcing member to be joined or juxtaposed to each other, and enclosing the periphery of the electroacoustic transducer element and the reinforcing member with the damper member thereby providing protection for the electroacoustic transducer element and heightening the efficiency of electroacoustic conversion.

12 Claims, 16 Drawing Figures

EAR MICROPHONE UTILIZING VOCAL BONE VIBRATION AND METHOD OF MANUFACTURE THEREOF

BACKGROUND OF THE INVENTION

1. Field of the Invention

This invention relates to a displacement type ear microphone and a method for the manufacture thereof, and more particularly to a displacement type ear microphone sensing bone vibration having an electroacoustic transducer element thereof rendered hard to break.

2. Description of the Prior Art

First the conventional displacement type vocal bone vibration ear microphone will be described with reference to FIG. 1 and FIG. 2.

FIG. 1 is a perspective view illustrating an appearance of the conventional displacement type vocal bone vibration ear microphone. FIG. 2 is a perspective view illustrating an appearance of the microphone of FIG. 1 after removal of a damper member thereof.

As illustrated in FIG. 2, a bar-shaped or ribbon-shaped electroacoustic transducer element 2 such as a bimorph cell of barium titanate ceramic, for example, is planted in a support member 1. To the support member 1 side end of the electroacoustic transducer element 2 is electrically connected a lead wire 3. This lead wire 3 is extended through the support member 1 and led out of the microphone.

Around the bar-shaped or ribbon-shaped electroacoustic element 2, a cylindrical damper member 4 formed of silicone mold or other rubbery substance is disposed as illustrated in FIG. 1. This damper member 4 is produced so that the circular cross section perpendicular to the axis thereof is virtually equal to or slightly smaller than the diameter of the auditory meatus (the auditory canal). Thus, the damper member 4 suits insertion in the auditory meatus.

In the displacement type vocal bone vibration ear microphone constructed as described above, when the microphone is inserted in the auditory meatus, the bone vibration transmitted to the auditory meatus flexes the damper member 4 and consequently flexes the electroacoustic transducer element 2 as well. By the electroacoustic transducer element 2, this bone vibration is converted into an electrical signal. The electric signal is forwarded through the lead wire 3 to a device of subsequent step (not shown) connected thereto.

The conventional displacement type vocal bone vibration ear microphone has an advantage that it satisfactorily picks up only the bone vibration, perfectly avoids picking up the aerial vibration such as noise, and sparingly induces howling. It nevertheless entails a disadvantage that since the electroacoustic transducer element is mechanically fragile, it must be handled with the greatest possible care lest it should be exposed to unwanted external force.

The inventor, therefore, has experimentally manufactured a displacement type bone vibration ear microphone constructed to have an electroacoustic transducer element thereof rendered hard to break as illustrated in FIG. 3.

In this microphone, three inflexible piano wires 5*a*, 5*b*, and 5*c* are planted on a support member 1 at three points around an electroacoustic transducer element 2 and a damper member 4 is molded of silicone resin to enclose the piano wires.

In this microphone, the damper member 4 is not flexed even when it is exposed to any unwanted external force because it is reinforced with the three piano wires 5*a*, 5*b*, and 5*c*. As the result, the electroacoustic transducer element 2 is not flexed by such an external force and is prevented from breakage.

In the displacement type bone vibration ear microphone of this construction, however, the piano wires are not effectively utilized as an auxiliary vibrator for the electroacoustic transducer element because the piano wires are too rigid to flex and further because the piano wires are separated from the electroacoustic transducer element. This microphone, therefore, suffers from a disadvantage that it has poor sensitivity in picking up the bone vibration.

SUMMARY OF THE INVENTION

An object of this invention is to overcome the aforementioned drawbacks suffered by the prior art and provide a displacement type bone vibration microphone which has an electroacoustic transducer element thereof rendered hard to break and which is capable of amply picking up the bone vibration and a method for the manufacture thereof.

This invention, directed to a displacement type bone vibration microphone comprising an electroacoustic transducer element fixally supported on one of the opposite end faces of a support member and a damper member formed to enclose therewith the electroacoustic transducer element, is characterized by disposing a flexible reinforcing member around or near the electroacoustic transducer element, allowing the outer end of the reinforcing member to be engaged with or juxtaposed to the free end (not supported in the support member) of the electroacoustic transducer element, and enclosing the electroacoustic transducer element and the reinforcing member with the aforementioned damper member, and adapting the reinforcing member to fulfil the two functions, i.e. reinforcement of the electroacoustic transducer element and detection of the vocal bone vibration.

DETAILED DESCRIPTION OF THE INVENTION

Now, the present invention will be described below with reference to preferred embodiments.

Figure 2:
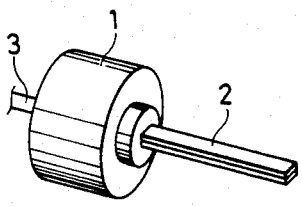
FIG. 2 PRIOR ART
FIG. 2 is a perspective view illustrating an appearance of the microphone of FIG. 1 after removal of the damper member.
Figure 4:
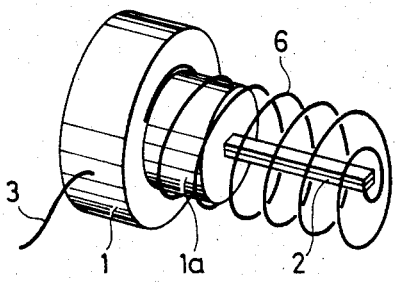
FIG. 4 is a perspective view of the essential part of a first embodiment of this invention.

FIG. 4 is a perspective view of the essential construction of the first embodiment of this invention. In the diagram, 6 denotes a coil spring of metallic or plastic material having one end thereof fastened to a projection 1*a* of a support member 1, the central part thereof disposed so as to surround the periphery of an electroacoustic transducer element 2, and the other end therof fastened or juxtaposed to the free end of the electroacoustic transducer element 2. The other numerical symbols used herein denote the same components as shown in FIG. 2.

Figure 5:
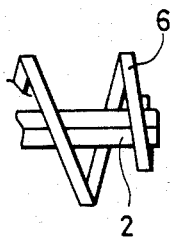
FIG. 5 and FIG. 6 are each a side view illustrating the relation between the free end of an electroacoustic transducer element and the outer end of a coil spring in the first embodiment of this invention.
Figure 6:
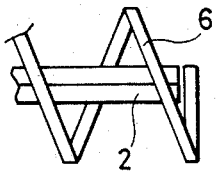

FIG. 5 and FIG. 6 are magnified side views illustrating the neighborhood of the free end of the electroacoustic transducer element 2 of the embodiment of FIG. 4.

FIG. 5 represents a case in which the aforementioned outer end of the coil spring 6 is wrapped around the aforementioned free end of the electroacoustic transducer element 2. The aforementioned outer end of the coil spring 6 may be fastened to the free end of the electroacoustic transducer element 2 by soldering or by adhesion as with a resin of high rigidity or may be juxtaposed thereto (closely spaced) without fixation.

FIG. 6 represents a case in which the aforementioned outer end of the coil spring 6 is disposed on the extension of the electroacoustic transducer element 2. Again in this case, similarly to the preceding case, the aforementioned outer end of the coil spring 6 may be fastened to or juxtaposed to the free end of the electroacoustic transducer element 2.

The rigidity of the coil spring 6 which is determined by various factors such as pitch, material, and thickness, coupled with the rigidity of the damper member molded around the coil spring 6, is such that the coil spring 6 will not readily collapse under the pressure exerted by the finger tip in the radial direction thereof and is such that it will be acoustically flexed by the force exerted thereon in the direction perpendicular to the axis thereof and will be capable of transmitting bone vibration to the electroacoustic transducer element 2.

Figure 1:
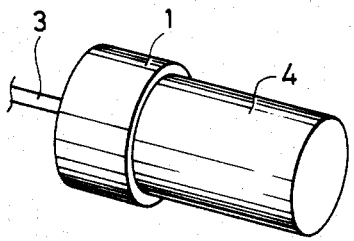
FIG. 1 PRIOR ART
FIG. 1 is a perspective view illustrating an appearance of the conventional displacement type vocal bone vibration ear microphone.

The construction of FIG. 4 formed as described above is immersed in liquid silicone resin placed in a cylindrical die. Then, the silicone resin is left setting to give rise to a damper member covering the coil spring 6. Consequently, there is produced a displacement type vocal bone vibration ear microphone of a shape the outward appearance of which is as shown in FIG. 1.

The displacement type vocal bone vibration ear microphone of the present embodiment may be otherwise manufactured by the following procedure, for example. A through hole permitting insertion of the electroacoustic transducer element 2 is bored in advance through the support member 1 and the projection 1*a*. First to the projection 1*a*, one end of the coil spring 6 is fastened as illustrated in FIG. 4. Then, silicone resin is placed to fill the interior of the coil spring 6 and enclose the exterior thereof except for a hole running axially through the central part of the coil spring 6 in the direction of length and consequently communicating with the aforementioned through hole and permitting insertion therein of the electroacoustic transducer element 2. The silicone resin is left setting to give rise to the damper member. Then, the electroacoustic transducer element 2 is thrust in the through hole of the aforementioned support member 1 and the projection 1*a* is inserted in the hole reserved in the central part of the coil spring 6. Subsequently, silicone adhesive agent or other similar substance is cast in the gap between the electroacoustic transducer element and the aforementioned damper member to fill up the aforementioned gap and consequently enhance the sensitivity of the produced microphone. For the sake of mechanical protection of the electroacoustic transducer element 2, it is more desirable to leave this gap partially unfilled than to fill up the gap completely.

In the displacement type vocal bone vibration ear microphone of the present embodiment, the coil spring enjoys enhanced rigidity against stress because the coil spring 6 is disposed around the electroacoustic transducer element 2 and the damper member 4 is disposed between the adjacent turns of the coil spring 6. As the result, the electroacoustic transducer element 2 is reinforced. This reinforcement is effective in keeping the electroacoustic transducer element 2 clear of any appreciable external force and preventing the electroacoustic transducer element 2 from otherwise possible breakage even when the microphone is exposed to any external force tending to bend, twist, or axially press the microphone.

Further in the present embodiment, the vocal vibration transmitted through the bone to the external auditory meatus is relayed through the damper member 4 to the coil spring of a large area of vibration constituting itself the primary vibration system and thence transmitted to the free end of the electroacoustic transducer element 2 constituting itself the secondary vibration system. As the result, there can be derived as large an output as is obtainable by the microphone of FIG. 1 and FIG. 2. In the present embodiment, when the coil spring happens to be made of a metallic material, the coil spring brings about an effect of shielding the displacement type vocal bone vibration microphone against extraneous electromagnetic waves and intercepting electric noise.

Figure 7:
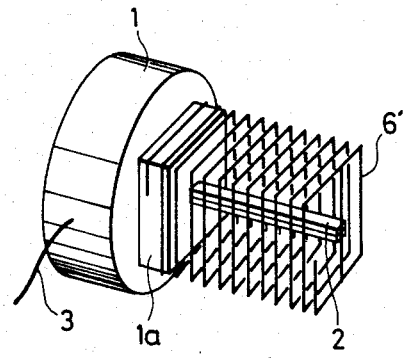
FIG. 7 is a perspective view illustrating one modification of the first embodiment.

FIG. 7 represents one modification of the present embodiment. This modification consists in using a rectangular coil spring 6′ in the place of the cylindrical coil spring 6 of the first embodiment. This modification is as effective as the first embodiment. The spiral shape of the coil spring 6 or 6′ in the cross section taken perpendicularly to the axis of the coil spring is not limited to a circle or rectangle. Optionally, it may be an ellipse, a triangle, or other figure.

Figure 8:
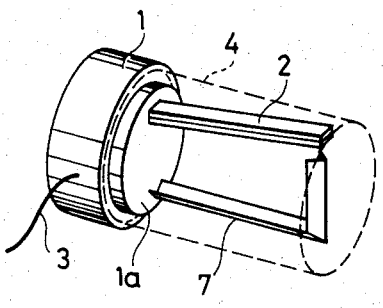
FIG. 8 and FIG. 9 are each a perspective view of a second embodiment of this invention.
Figure 9:
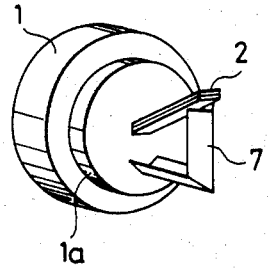

FIG. 8 and FIG. 9 illustrate a second embodiment of this invention. FIG. 8 is a perspective view and FIG. 9 is a perspective view of FIG. 8 as seen in the direction of the free end of the electroacoustic transducer element 2. The same numerical symbols found in the diagrams as those found in FIG. 1 and FIG. 2 denote identical or equal components. In FIG. 8, the damper member 4 is indicated by a dotted line to facilitate illustration.

In the embodiment of FIGS. 8 and 9, an electroacoustic transducer 2 and a slender reinforcing member 7, formed of a phosphor bronze sheet in a V-shaped cross section, are supported in the projection 1*a* of the support member 1, with aforementioned reinforcing member 7 bent at one point in the entire length thereof so that the free or outer ends of these components are opposed and adjacent to each other. Optionally, these opposed outer ends are joined by being soldered or fastened with rigid resin. Optionally, the opposed outer ends may be left separated by only a slight gap instead of being tightly joined.

The thickness or strength of the aforementioned reinforcing member 7 of phosphor bronze sheet is selected so that the reinforcing member 7 formed in a V-shaped or U-shaped cross section will avoid being appreciably bent under the force exerted by the finger tip and will exhibit ample acoustic flexibility. Thus, the reinforcing member 7 resists breakage even when the microphone is handled roughly. Further in the present embodiment the bone vibration transmitted through the bone to the external auditory meatus is conveyed directly, or indirectly via the damper member 4, to the electroacoustic transducer element 2. The bone vibration is also transmitted to the electroacoustic transducer element 2 through the open end of the reinforcing member 7 which functions as an auxiliary means for transmitting the vocal bone vibration to the electroacoustic transducer element 2. Thus, the vocal bone vibration can be picked up efficiently.

Figure 10:
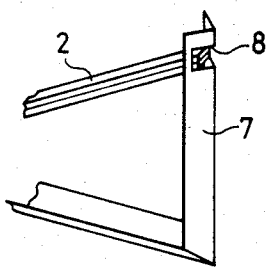
FIG. 10 is a perspective view of the essential part of one modification of the second embodiment.

FIG. 10 represents one modification of the present embodiment. It is a magnified perspective view illustrating the neighborhood in which the free or unsupported end of the electroacoustic transducer element 2 and the outer end of the reinforcing member 7 are opposed to each other. In this modification, the reinforcing member 7 is provided near the outer end thereof with an opening 8 and the electroacoustic transducer element 2 is disposed so that the free end thereof will terminate in the opening 8.

In the microphones of FIG. 8 and FIG. 10, the formation of the damper member 4 around the electroacoustic transducer element 2 and the reinforcing member 7 may be effected by supporting the electroacoustic transducer element 2 and the reinforcing member 7 in the projection 1*a* of the support member 1 as described above, immersing them in liquid silicone resin held inside a suitable die, and allowing the silicone resin to cure, or by supporting the reinforcing member 7 in the projection 1*a* of the supporting member 1, then forming the damper member 4 with silicone resin in a cylindrical shape while leaving behind a hole for permitting insertion therein of the electroacoustic transducer element 2, and thereafter allowing the electroacoustic transducer element 2 of the shape of a ribbon to be inserted first in the through hole formed in advance in the aforementioned support member 1 and then into the hole left unfilled in the damper member 4.

FIG. 8 illustrates use of only one reinforcing member 7 of phosphor bronze sheet. The number of reinforcing members 7 is not limited to one. Optionally, a plurality of reinforcing members of the same shape may be incorporated in one microphone. The illustrated embodiment is described as using the reinforcing member 7 of phosphor bronze sheet in a folded shape. Of course, this reinforcing member 7 may be in an arcuately curved shape.

Figure 14:
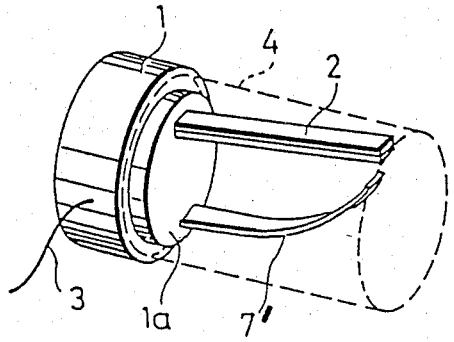
FIG. 14 is a perspective view of a fifth embodiment of this invention.

A modified form of the ear microphone shown in FIG. 8 is illustrated in FIG. 14. The numbering is the same for identical elements. The support member 1 has a projection 1*a* which supports an electroacoustic transducer element 2. The electroacoustic transducer element 2 is offset from the center of the support member as also shown in FIG. 8. A reinforcing bar member 7' is supported at one end in support member 1, and has a curved bar shape so that the outer or free end of bar member 7' is juxtaposed, or in other words is closely spaced from and adjacent the outer or free end of electroacoustic transducer element 2. The outer ends of the curved bar member 7' and of the electroacoustic transducer element 2 can be joined as previously described, if desired.

Figure 11:
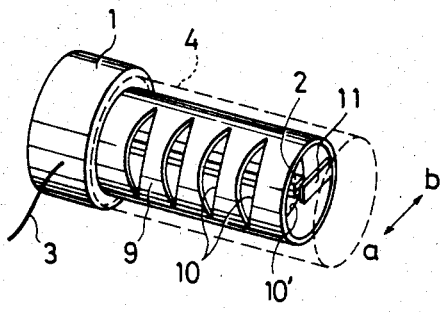
FIG. 11 is a perspective view of a third embodiment of this invention.

A third embodiment of this invention is illustrated in FIG. 11. In this diagram, the same numerical symbols as those found in FIG. 1 and FIG. 2 denote identical or equal components.

This embodiment is characterized by enclosing the periphery of the electroacoustic transducer element 2 with a cylindrical member 9 of thin brass sheet containing a multiplicity of slits 10, 10' cut in circumferential direction or other similar holes and filling the interior and covering the exterior of this cylindrical member 9 with a damper member 4 formed of silicone resin. The slits 10 and the slits 10' are disposed substantially symmetrically with respect to the axis of the cylindrical member 9.

When force is exerted upon the damper member 4 in the horizontal direction (the direction of the arrows a, b shown in the diagram) substantially perpendicular to the axis of the damper member 4, therefore, the damper member generates flexure in that direction. This flexure is transmitted to the electroacoustic transducer element 2 via a bar-shaped member 11 fixed at one base end thereof and extended in the diametric direction across the free or outer end of the cylindrical member 9. Thus, the vocal bone vibration transmitted through the auditory meatus can be picked up advantageously. Even when the microphone is exposed to any unwanted external force, the electroacoustic transducer element 2 will not be broken because it is enclosed with the cylindrical member 9 and, therefore, will flex only minimally under such external force.

Figure 12:
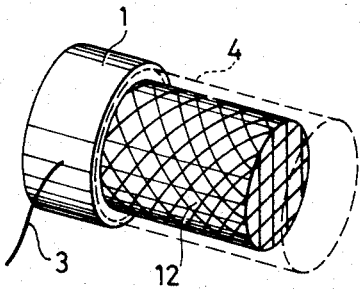
FIG. 12 is a perspective view of a fourth embodiment of this invention.

FIG. 12 is a perspective view of a fourth embodiment of this invention. In this diagram, the same numerical symbols as those found in FIG. 1 and FIG. 2 denote identical or equal components.

This embodiment is characterized by enclosing the electroacoustic transducer element (not shown) with a fibrous sleeve 12 formed of mesh of metallic or glass fibers and filling the interior and covering the exterior of this sleeve 12 with the damper member 4 formed of silicone resin.

In this embodiment, since the electroacoustic transducer element is covered with the fibrous sleeve 12 and the damper member of silicone resin, it is prevented from generating any appreciable flexure even under a heavy external force. Thus, the electroacoustic transducer element is not very susceptible to breakage under external force. On the other hand, on exposure to the bone vibration, the fibrous sleeve and the electroacoustic transducer element covered with silicone resin are flexed to an extent sufficient to effect conversion of the bone vibration into an electric signal. Thus, the electroacoustic transducer element is capable of picking up the bone vibration with high sensitivity.

In the third and fourth embodiments, the cylindrical member 9 and the fibrous sleeve 12 may have elliptic cross sections in a plane perpendicular to the axis thereof. When the cylindrical member 9 and the fibrous sleeve 12 are made of metal sheet and metal mesh respectively, they bring about an effect of shielding the electroacoustic transducer element against external electromagnetic waves and intercepting electric noise.

The microphone of any of the embodiments described above is covered with a damper member possessing impedance approximating the mechanical impedance of the wall of the external auditory meatus. When the microphone is set in place on the wall of the external auditory meatus, therefore, the vocal bone vibration is transferred from the wall of the external auditory meatus to the damper member with virtually no reflection. As the result, the energy of the vocal bone vibration is not lost at all. Thus, the vocal bone vibration can be transferred from the wall of the external auditory meatus to the microphone with high efficiency.

Figure 3:
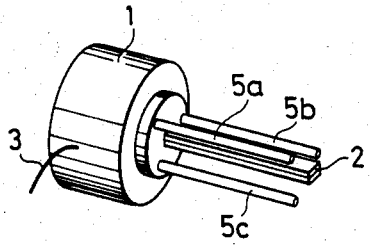
FIG. 3 PRIOR ART
FIG. 3 is a perspective view of the essential part of an ear microphone having a reinforced electroacoustic transducer element experimentally manufactured by the inventor.

The experimental displacement type bone vibration microphone illustrated in FIG. 3, the microphone of the first embodiment shown in FIG. 4, and the microphone of the second embodiment shown in FIG. 8 were used to pick up bone vibration, with the outputs measured by a synchroscope. Envelopes of the waveforms of the electric signal outputs thus obtained are shown in FIG. 13.

FIGS. 13A, B, and C respectively represent the envelopes of the waveforms of electric signal outputs obtained when the vocal bone vibrations of the Japanese vowels " [u], [o], [a], [e], and [i]" (phonetically equivalent approximately to the English vowels were picked up by the microphones of FIG. 3, FIG. 4, and FIG. 8.

Figure 13:
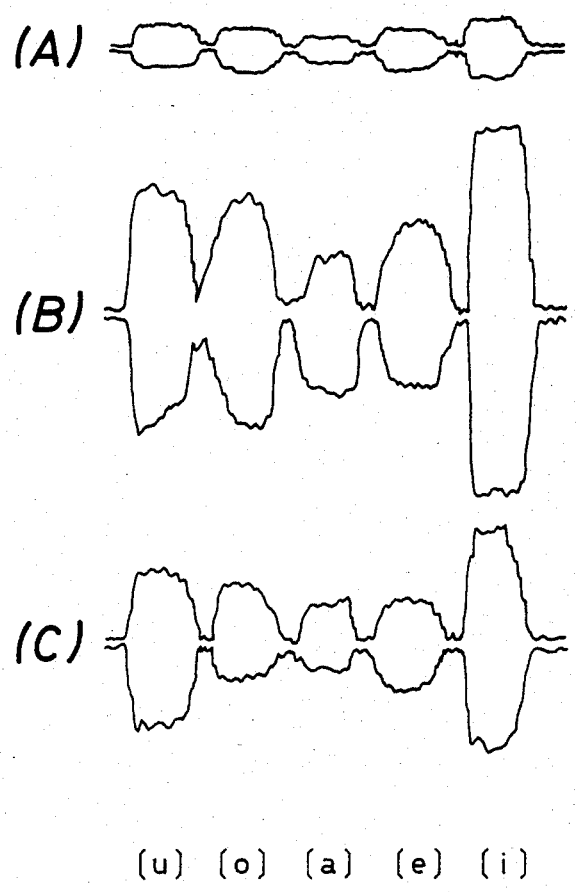
FIGS. 13*a*–13*c* show an envelope diagram of a waveform showing electric signal outputs obtained by picking up the vocal bone vibration with the ear microphones of FIG. 3, FIG. 4, and FIG. 8 respectively.

A look at FIG. 13 reveals that the microphone of FIG. 3 exhibits very poor sensitivity in picking up the vocal bone vibration as is apparent from FIG. 13A. It is also noted that the microphone of the first embodiment of FIG. 4 exhibits the highest sensitivity as in apparent from FIG. 13B and the microphone of the second embodiment of FIG. 8 exhibits sensitivitly slightly inferior to that of the microphone of the first embodiment as is apparent from FIG. 13C. It is found, however, that the microphone of the second embodiment is as amply sensitive for practical purpose as that of the first embodiment and that the former is not inferior at all to the latter in any respect.

As is evident from the foregoing description, this invention has a salient effect that the strength of the electroacoustic transducer element which has constituted one weak point of the conventional displacement type vocal bone vibration microphone can be sufficiently reinforced and, therefore, the displacement type vocal bone vibration microphone is not susceptible to breakage any longer even when it is handled with considerable roughness. The microphone of this invention is also effective in picking up the vocal bone vibration with as high sensitivity as the microphone illustrated in FIG. 1 and FIG. 2.

What is claimed is:

1. In a displacement type bone vibration ear microphone having a support member with end faces, an electroacoustic transducer element supported in one of the end faces of the support member and extending outwardly therefrom and having an outer free end, and a damper member formed so as to enclose therewith said electroacoustic transducer element, the displacement type bone vibration ear microphone characterized by a flexible reinforcing member disposed adjacent said electroacoustic transducer element and extending outwardly from the support member and having an outer end, the outer end of said electroacoustic transducer element and the outer end of said reinforcing member being adjacent to each other, and said damper member enclosing the periphery of said electroacoustic transducer element and said reinforcing member thereby providing protection for said electroacoustic transducer element and heightening the efficiency of electroacoustic conversion.

2. A displacement type bone vibration ear microphone according to claim 1, wherein said reinforcing member is formed of a coil spring and said coil spring is disposed so as to surround said electroacoustic transducer element.

3. A displacement type bone vibration ear microphone according to claim 1, wherein said reinforcing member is formed of a cylindrical member having a multiplicity of holes bored in the wall thereof and said cylindrical member is disposed so as to surround said electroacoustic transducer element.

4. A displacement type bone vibration ear microphone according to claim 1, wherein said reinforcing member is formed of a fibrous sleeve and said fibrous sleeve is disposed so as to enclose therewith said electroacoustic transducer element.

5. A displacement type bone vibration ear microphone according to claim 1, wherein the reinforcing member comprises a flexible bar-shaped member supported in conjunction with said electroacoustic transducer element in one of the end faces of said support member, said bar-shaped member extending outwardly so that an outer end of said bar-shaped member and the outer end of said electroacoustic transducer element are adjacent to each other.

6. The displacement type bone vibration ear microphone according to claim 1, wherein the outer ends of said electroacoustic transducer element and said reinforcing member are joined together.

7. The displacement type bone vibration ear microphone according to claim 2, wherein said coil spring has a cylindrical shape formed around a central axis extending from said support member.

8. A displacement type bone vibration ear microphone according to claim 2 wherein said coil spring has a generally rectilinear shape when viewed in cross section perpendicular to a longitudinal axis extending along the length of the electroacoustic transducer element.

9. The displacement type bone vibration ear microphone according to claim 5, wherein said bar shaped member is curved from position where it is supported on said support member to its outer end.

10. A displacement type bone vibration ear microphone according to claim 9 wherein the outer end of said bar type member and the outer end of said electroacoustic transducer element are joined together.

11. A displacement type bone vibration ear microphone according to claim 5 wherein said reinforcing member comprises a bar-shaped member that extends generally parallel to the electroacoustic element from said support member, and has a bent end portion at its outer end that is bent toward the outer end of the electroacoustic transducer element.

12. A method for the manufacture of a displacement type bone vibration ear microphone, characterized by comprising the steps of providing a supporting member having at least one end, supporting an electroacoustic transducer element in the one end of the supporting member, the electroacoustic transducer element having an outer end, mounting a reinforcing member for said electroacoustic transducer element in said one end of said supporting member to form an assembly, the reinforcing member having an outer end, the outer ends of said electroacoustic transducer element and said reinforcing member being adjacent to each other, inserting the outer ends of the electroacoustic transducer element and reinforcing member of the assembly into a cylindrical die, filling said cylindrical die with liquid resin for formation of a damper member until at least said electroacoustic transducer element and said reinforcing member are completely submerged thereunder, and then curing said resin.

* * * * *